US005749977A

United States Patent [19]

Lallier et al.

[11] Patent Number: 5,749,977

[45] Date of Patent: May 12, 1998

[54] PROCESS AND COMPOSITION FOR DEGREASING THE SURFACE OF AN OBJECT

[75] Inventors: Jean-Pierre Lallier, Levallois-Perret; Daniel Bignon, Fontenay-Sous-Bois, both of France

[73] Assignee: Elf Atochem S.A., Puteaux, France

[21] Appl. No.: 738,691

[22] Filed: Oct. 28, 1996

Related U.S. Application Data

[63] Continuation of Ser. No. 424,455, PCT/FR93/01045 filed on Oct. 26, 1993, abandoned.

[30] Foreign Application Priority Data

Oct. 28, 1992 [FR] France ..... 92 12846

[51] Int. Cl.[6] ..... B08B 3/04; C23G 5/02; C23G 5/024; C23G 5/032

[52] U.S. Cl. ..... 134/40; 134/41; 510/245; 510/246; 510/365

[58] Field of Search ..... 134/40, 41, 3; 510/245, 246, 365, 181, 182, 219, 238, 243, 254, 506

[56] References Cited

U.S. PATENT DOCUMENTS

| | | | |
|---|---|---|---|
| 3,539,518 | 11/1970 | Feighner et al. | 252/89 |
| 3,761,429 | 9/1973 | Yamano | 252/547 |
| 4,022,808 | 5/1977 | Yoshihara et al. | 260/410.6 |
| 4,420,484 | 12/1983 | Gorman et al. | 424/326 |
| 5,076,954 | 12/1991 | Loth et al. | 134/40 |

FOREIGN PATENT DOCUMENTS

| | | |
|---|---|---|
| 0 160 762 | 11/1985 | European Pat. Off. . |
| 0 432 878 | 6/1991 | European Pat. Off. . |
| 91/10718 | 7/1991 | WIPO . |

OTHER PUBLICATIONS

EPO Abstract, 93/349139 Week 9344, SU1768626, Oct. 15, 1992.

EPO Abstract, 93/064882, Week 9308, SU1719426, Mar. 15, 1992.

EPO Abstract, 91/272103, Week 9137, SU1616983, Dec. 30, 1990.

EPO Abstract, 91/243797, Week 9133, RD327076, Jul. 10, 1991.

EPO Abstract, 82/13168E, Week 8207, SU825611, Apr. 30, 1981.

Derwent WPI Abstract, EP 0 335 295, Sep. 6, 1995.

*Primary Examiner*—Zeinab El-Arini

*Attorney, Agent, or Firm*—Millen, White, Zelano, & Branigan, P.C.

[57] ABSTRACT

For degreasing the surface of an object, applying thereto a composition containing at least 25% by weight of an amphiphilic compound of the formula A—B, wherein A is a lipophilic and hydrophobic radical and B is a hydrophilic radical, e.g., an alkyleneglycol ether oxide having a terminal group of at least 10 carbon atoms, then rinsing the surface with water.

20 Claims, No Drawings

PROCESS AND COMPOSITION FOR DEGREASING THE SURFACE OF AN OBJECT

This application is a continuation of application Ser. No. 08/424,455, filed Apr. 27, 1995 now abandoned, which was a national stage application of PCT/FR93/01045 filed Oct. 26, 1993.

BACKGROUND OF THE INVENTION

The present invention relates to the degreasing of the surface of a metal, ceramic, glass or plastic object.

The most effective degreasing processes are carried out using chlorinated solvents, especially 1,1,1-trichloroethane. These are products which are harmful to the environment, especially the stratospheric ozone layer. It is envisaged that their use will be prohibited in the years to come. There are also aqueous processes which are less effective in spite of their complex formulations based on water, saponifying agents (sodium hydroxide, potassium hydroxide, silicate, phosphate, borate or carbonate), chelating agents and surfactants.

A process and a composition have now been found which can be used for degreasing the surface of an object in a more effective manner than 1,1,1-trichloroethane without having the drawbacks thereof and without the need for combining in complex formulations.

SUMMARY OF THE INVENTION

The invention thus relates to a process for degreasing the surface of a metal, ceramic, glass or plastic object, which comprises applying thereto a composition comprising an amphiphilic compound of formula A—B, wherein A is a lipophilic and hydrophobic radical and B is a hydrophilic radical. The process is characterised in that it comprises using a composition containing at least 25% and, preferably, at least 60% by weight of the amphiphilic compound of formula A—B which thus acts as solvent, so as to form an amalgam of oil or grease with the A—B compound by means of the radical A, then rinsing the surface with water so as to eliminate the amalgam from the surface, this elimination being made possible by the hydrophilic nature of the amalgam due to the presence of the radical B.

The amphiphilic solvent of structure A—B is selected so that the part A has a better affinity for the oil in question. Preferably, this amphiphilic solvent will be used pure. If this is not possible, one or more cosolvents will be added thereto, taking care to use as little as possible. In fact, if the amphiphilic solvent is diluted too much, it will no longer be able to perform its function of forming the amalgam and will play its conventional part (in a non-performing manner) of surfactant. In classic detergent science, the surfactant is adsorbed in the oil so as to minimize the surface tension between the oil and the aqueous solution. The oil stain is removed, forming a drop so as to minimize the interfacial tension. The surfactant can thus be used to obtain a dispersion of oil in the aqueous solution. The levels of surfactants used are generally low (of the order of a few percent).

The purpose of adding amphiphilic solvent to the layer of grease is to increase the hydrophilic nature of this layer. The amphiphilic solvent dissolves the layer of grease readily or is highly miscible therewith, by reason of its A segment which has a very high affinity for oils and greases. This very good dissolution or miscibility leads to the formation of an amalgam of oil and amphiphilic solvent. As a result of its hydrophilic nature, this amalgam is easily removed by simply rinsing with water. Part B of the amphiphilic solvent may be, for example, an ionic head or an ethoxylated chain.

The amphiphilic solvents used may be, in particular, alkylsulphates, alkylether sulphates, nonylphenylether sulphates, sulphosuccinates, hemisulphosuccinates, alkylbenzene sulphonates, amino acid or protein derivatives, ethoxylated fatty alcohols, ethoxylated fatty acids, ethoxylated fatty esters, sorbitan esters, ethoxylated sorbitan esters, ethoxylated alkyl phenols, fatty amides, fatty esters, oxyethylated primary monoamines, oxyethylated diamines, primary monoamine acetates, diamine diacetates, diamine dioleates, quaternary ammonium salts, amine oxides, ether amines and ether diamines. It is particularly preferred to use alkyleneglycol etheroxides of the formula

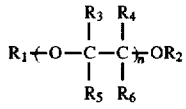

wherein $R_1$ is a hydrogen atom or a hydrocarbon group, optionally substituted, having 1 to 20 carbon atoms or a hydrocarbyl carbonyl group ($R_7$—COO—, wherein $R_7$ denotes H, alkyl or alkenyl having 1 to 20 carbon atoms; this definition also applies to the other hydrocarbon groups) having 1 to 21 carbon atoms, $R_2$ is a hydrogen atom or a hydrocarbon group, optionally substituted, having 1 to 20 carbon atoms, at least one of $R_1$ and $R_2$ having at least 10 carbon atoms, $R_3$, $R_4$, $R_5$ and $R_6$, which may be identical or different, denote hydrogen or a hydrocarbon group, optionally substituted, having from 1 to 6 carbon atoms, and n is an integer from 1 to 12.

In fact, it has been found that, owing to their long hydrocarbon chain, more particularly having 11 to 18 carbon atoms, and owing to the presence of an ethoxylated segment, these alkyleneglycol ether oxides are highly effective in degreasing a surface. The alkyleneglycol ether oxides in which $R_1$ has at least 10 carbon atoms are particularly preferred. The hydrocarbon group which constitutes $R_1$ or $R_2$ may be, in particular, alkyl, alkenyl, cycloalkyl, alkylaryl and aralkyl, and particularly substituted by a hydroxyl group or by a hydroxyalkoxy group. $R_1$ may be obtained from an acetate, a propionate, a butoxide, a valerate, a cyclopentacarboxylate, a caproate, a cyclohexacarboxylate, an enanthoate, a benzoate, a caprylate, a perlagonate, a caprate, a laurate, a myristate, a palmitate, a stearate or an oleate. $R_2$ may denote methyl, ethyl, propyl, amyl, octyl, decyl, dodecyl, tetradecyl, hexadecyl, octadecyl, vinyl, octyl, dodecyl, pentadecyl or oleyl. When $R_1$ is a ricinyl radical this is a product derived from natural castor oil. The most common and hence preferred alkyleneglycol ether oxides are those wherein $R_3$, $R_4$, $R_5$ and $R_6$ are hydrogen atoms.

The invention also relates to a degreasing composition which contains by weight 85 to 25% especially 85 to 60% of the compound A—B. When the oil which is to be eliminated from the surface is very viscous, the composition makes it more fluid and thus facilitates its subsequent removal with water. When mixtures of alkyleneglycol ether oxides are used in the composition, the composition is heterogeneous. Simple stirring will make it homogeneous for several hours. This homogenizing may be made easier by heating to a temperature between 30° and 60° C. and preferably between 30° and 40° C. In order to homogenize the composition permanently, 15 to 20% by weight of water and preferably 15 to 18% by weight of water may be added thereto. It is advisable to add no more than 20% of water or a gel may be formed and viscous and heterogeneous mixtures may be obtained instead of an oily product.

Once the composition has been placed on the surface which is to be degreased, the step of rinsing with water frequently gives a viscous gel which can be eliminated by mechanical action (rubbing or high-pressure jet). To overcome this disadvantage, 10 to 20% by weight of an agent which promotes water-miscibility of the compound A—B especially alkyleneglycol ether oxide may be added to the composition. This agent may be a lower alcohol, especially an alkanol or a glycol. In particular, diacetone alcohol may be used, or an alkyleneglycol such as an alkylglycol, hexyleneglycol, a branched alkanol such as sec.butanol or even ether oxides such as diethyleneglycol monobutyl oxide or other glycol ether oxides which are of particular interest by virtue of their low toxicity. The quantity of agents promoting miscibility is advantageously between 10 and 20% by weight. In its most preferred form, a composition according to the invention may contain 60 to 75% by weight of the alkyleneglycol ether oxide or a mixture thereof, 15 to 20% by weight of water and 10 to 20% by weight of an agent which promotes miscibility of the alkyleneglycol ether oxide in water.

The invention also relates to a process for degreasing the surface of an object, which comprises applying 0.2 to 1 mg of a compound A—B, particularly an alkyleneglycol ether oxide as mentioned above or a composition as mentioned above, per square centimeter of the surface. The period of application of the amphiphilic product A—B to the layer of grease may range from at least about one second to 10 minutes or more depending on the size of the surface to be cleaned. After this, the alkyleneglycol ether oxide is removed from the surface by applying water thereto, this application being carried out by immersion, spraying or by wiping the surface with a damp cloth. It is also possible to use a water jet.

A process for preparing the alkyleneglycol ether oxides used according to the invention will be found in U.S. Pat. No. 4,022,808 and in European Patent Application No. 335 295.

The Examples which follow illustrate the invention.

Alkyleneglycol ether oxides known as "ethoxylated metiloils" were used, which can be obtained from the company Seppic, 75 quai d'Orsay, Paris, France. These compounds contain 2 to 5 moles of ethylene oxide. $R_2$ is methyl and $R_1$ is a mixture of C11, C13 and C18 monocarbonylated hydrocarbons. They are essentially methyl esters. On average, either 2 moles of ethylene oxide (OE) or 5 moles of ethylene oxide have been added to the metiloil.

The ethoxylated metiloils are therefore complex mixtures as a result of the composition of the metiloil and the degree of ethoxylation. This complexity leads to heterogeneity of the product for the metiloil 5 OE. Thus, attempts were initially made to render the product homogeneous (existence of a single phase at ambient temperature, e.g. 20° C.).

This mixture becomes homogeneous as the result of the addition of 15 to 18% of water. However, if 20% or more water is added, lamellaire phases are formed (gel) and viscous heterogeneous mixtures are obtained. These gels seem all the more persistent the higher the OE number (8 OE, 10 OE and 12 OE). The metiloil 2 OE gives milky emulsions with water in any proportions and these emulsions rapidly become viscous.

Metiloil 5 OE remains heterogeneous at ambient temperature. Above 20% water it produces a gel. It is therefore preferable to use the minimum amount possible, i.e. 15% by weight of water.

The second step of the process consists in rinsing the surface coated with the oil/amphiphilic solvent amalgam with water. This means, inter alia, adding water to the metiloil 5 OE formula, thereby obtaining a percentage of water greater than 20% and returning to the formation of lamellaire phases. This is effectively what happens during rinsing with water: a viscous gel is formed on the surface. In order to overcome this disadvantage, a cosolvent of the alcohol or glycol type was added. It is possible to use, for example, diacetone alcohol, hexyleneglycol, sec.butanol or diethyleneglycol monobutyl ether. The latter solvent, which is a member of the glycol ether family, has proved particularly useful by reason of its very low toxicity and its superior performance compared with other alcohols or glycols. The minimum quantity of diethyleneglycol monobutyl ether (BDG) is 15% by weight. The following mixtures were prepared:

77% Metiloil 5 OE+15% water+8% BDG.

75% Metiloil 5 OE+15% water+10% BDG.

70% Metiloil 5 OE+15% water+15% BDG.

Dilution of the first two formulae in water leads to the formation of a milky emulsion. Dilution of the third formulation in water results in a translucent phase which is characteristic of microemulsions. This is the desired result.

Thus, typically, 70% by weight of the amphiphilic solvent (Metiloil 5 OE) are used, to which 15 water and 15% BDG are added.

For any other amphiphilic solvent, this formulation study should be carried out taking account of the two desired properties: homogeneity of the starting product and miscibility with water in any proportions.

EXAMPLES

Example 1

The following formulation was used:

| | |
|---|---|
| Metiloil 5 OE | 70% |
| Diethyleneglycol monobutyl oxide | 15% |
| Water | 15% |

A thin layer of vaseline oil was placed on a steel plate NM 22 S measuring 10×10 cm, degreased by the cycle comprising trichloroethane in hot form, cold form and vapour phase. The plate coated with vaseline oil is rubbed with a cloth soaked in the above mixture. After 2 or 3 successive rubs, the plate is placed under a water jet (15 seconds). The film of water is spread very well, which indicates a clean surface. The angle of contact of a drop of water placed on a surface of this kind is between 50° and 60°.

With trichloroethane (T111) and only 2 successive rubs with the cloth, a greasy film remains on which the water appears in the form of droplets, indicating a greasy surface (the angle of contact of a drop of water placed on such as surface is much greater than 60°).

Two successive rubs with T111 are not sufficient. Results comparable with those obtained using the formula given above can only be achieved by using very much more T111 (as it evaporates) and by rubbing considerably more.

Example 2

The formula of Example 1 is diluted half and half with water. Thus, the following formulation was prepared and used in this Example:

| | |
|---|---|
| Metiloil 5 OE | 35% |
| Diethyleneglycol monobutyl oxide | 7.5% |
| Water | 57.5% |

Under these conditions, the quantity of water in relation to Metiloil 5 OE is much greater than 15%. The same is true of the quantity of diethyleneglycol monobutyl oxide (21% in relation to the Metiloil 5 OE).

The conditions are therefore such as to ensure miscibility of all the constituents in infinite dilution.

As described in Example 1 the degreasing test is carried out. A similar efficacy to that of Example 1 is obtained.

Example 3 (as a comparison)

The formula of Example 2 is diluted half and half with water. Thus, in this Example, the following formulation is used:

| | |
|---|---|
| Metiloil 5 OE | 17.5% |
| Diethyleneglycol monobutyl oxide | 3.5% |
| Water | 79% |

The quantities of diethyleneglycol monobutyl oxide and water in relation to the Metiloil 5 OE are well above 15%. The conditions are still such as to ensure miscibility of all the constituents in infinite dilution.

In this Example, the quantity of Metiloil 5 OE is considerably reduced and a point is reached where there is a need to use a detergent surfactant (maximum level).

In a similar manner to Example 1 but using the new formulation, the performances are poor and comparable to those achieved with T111 with only 2 successive rubs with a cloth. Consequently, when Metiloil 5 OE is used at a level corresponding to the maximum used for classic cleaning (15 to 20% surfactant), the efficacy is zero.

Example 4

In this new Example, sodium dodecyl benzene sulphonate is used as amphiphilic solvent. This compound AB has a lipophilic component (dodecyl benzene) and a hydrophilic component (ionic head consisting of Na sulphonate). This compound is solid at room temperature. Therefore it has to be dissolved in a liquid for use. The following formulation was prepared and used:

| | |
|---|---|
| Na dodecyl benzene sulphonate | 42.5% |
| Diethyleneglycol monobutyl oxide | 15% |
| Water | 42.5%. |

The mixture obtained is much more fluid than the 50% Na dodecylbenzenesulphate and 50% water mixture. This is due to the 15% diethyleneglycol monobutyl oxide. This fluidity enables the composition to be spread easily with a cloth as in Example 1.

The degreasing test is carried out as described in Example 1. An efficacy similar to that of Example 1 is obtained.

8 mixtures are prepared known as MeT 1 to MeT 8, in accordance with the formulations by weight given below. These mixtures are homogeneous products which are stable at low temperatures (about 5°) and which are not destabilised by infinite dilution with water (with the exception of Met 1).

| | | |
|---|---|---|
| MeT 1 | Metiloil 5 OE | 100% |
| MeT 2 | Metiloil 5 OE | 70% |
| | Diethyleneglycol monobutyl oxide | 15% |
| | Water | 15% |
| MeT 3 | Metiloil 5 OE | 70% |
| | Hexyleneglycol | 15% |
| | Water | 15% |
| MeT 4 | Metiloil 5 OE | 70% |
| | Diethyleneglycol monobutyl oxide | 8% |
| | Diacetone alcohol | 8% |
| | Water | 14% |
| MeT 5 | Metiloil 5 OE | 70% |
| | Hexyleneglycol | 8% |
| | Diacetone alcohol | 8% |
| | Water | 14% |
| MeT 6 | Metiloil 5 OE | 70% |
| | Sec.butanol | 10% |
| | Water | 20% |
| MeT 7 | Metiloil 5 OE | 50% |
| | Metiloil 2 OE | 20% |
| | Diethyleneglycol monobutyl oxide | 15% |
| | Water | 15% |
| MeT 8 | Metiloil 5 OE | 70% |
| | Ethyl alcohol | 15% |
| | Water | 15% |

Example 5

Example 1 is repeated but using the MeT 7 mixture instead of the MeT 2 mixture. The performances obtained are excellent and comparable with those obtained for MeT 2.

Example 6

Example 1 is repeated but using the mixtures MeT 3, MeT 4, MeT 5 or MeT 6. The performances obtained are very good and comparable with good degreasing using T 111 (cloth, rubbing vigorously a number of times).

Example 7

The same procedure is used as in Example 1 but rinsing the plate successively with methanol and water; MeT 1 gives good degreasing performances.

Example 8

The same procedure is used as in Example 1, using the mixtures MeT 2 or MeT 7, but applying the product by spraying or soaking (and not with a cloth), and the results are absolutely identical to those obtained in Example 5.

Example 9

Example 1 is repeated but using a mixture of 3 oils:

50% vaseline oil,

25% ALEDA oil (phosphochlorinated mineral oil),

25% ETIRELF oil (oil entirely without chlorine).

The results are equally good with MeT 2 and MeT 7.

Example 10

The same procedure is used as in Example 1, but using the oil KFP 5/8, the performances obtained are equally good with MeT 2 and MeT 7.

Example 11

Example 1 is repeated but using the mixture MeT 8: Similar results to those of Example 5 are obtained.

We claim:

1. A process for degreasing a surface of a metal, ceramic, glass or plastic object having oil or grease on said surface, which comprises applying thereto a composition consisting essentially of at least 60% by weight based on the total weight of the composition of an amphiphilic compound of formula A—B, wherein A is a lipophilic and hydrophobic radical and B is a hydrophilic radical, water and optionally an agent which promotes miscibility of the amphiphilic compound in water, such that the amphiphilic compound dissolves the oil or grease or is highly miscible therein so as to form an amalgam of oil or grease with compound A—B;

then rinsing the surface with water so as to eliminate the amalgam from the surface.

2. A process according to claim 1, wherein the amphiphilic compound is an alkylsulphate, an alkylether sulphate, a nonylphenylether sulphate, a sulphosuccinate, a hemisulphosuccinate, an alkylbenzene sulphonate, an amino acid or proteinaceous compound, an ethoxylated fatty alcohol, an ethoxylated fatty acid, an ethoxylated fatty ester, a sorbitan ester, an ethoxylated sorbinate ester, an ethoxylated alkylphenol, a fatty amide, a fatty ester, an oxyethylenated primary monoamine and an oxyethylenated diamine, a primary monoamine acetate, a diamine diacetate, a diamine dioleate, a quaternary ammonium salt, an amine oxide, an ether amine or an ester diamine.

3. A process according to claim 1, wherein the amphiphilic compound is an alkyleneglycol ether oxide of the formula

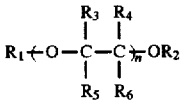

wherein $R_1$ is a hydrogen atom or a hydrocarbon group, optionally substituted, having 1 to 20 carbon atoms, or a hydrocarbylcarbonyl group having 1 to 21 carbon atoms, $R_2$ is a hydrogen atom or a hydrocarbon group, optionally substituted, having 1 to 20 carbon atoms, at least one of $R_1$ and $R_2$ having at least 10 carbon atoms, $R_3$, $R_4$, $R_5$ and $R_6$, which may be identical or different, denote hydrogen or a hydrocarbon group, optionally substituted, having 1 to 6 carbon atoms, and n is an integer from 1 to 12.

4. A process according to claim 3, wherein the composition comprises 15–20% water and 85–60% of the amphiphilic compound.

5. A process according to claim 4, wherein the composition further contains 10–20% of at least one of a lower alcohol, a diacetone alcohol, a glycol or a glycol ether oxide different from said amphiphilic compound so as to promote miscibility of the composition with water.

6. A process according to claim 5, wherein n is 2 to 5 inclusive, $R_2$ is methyl and $R_1$ is a mixture of $C_{11}$, $C_{13}$ and $C_{18}$ monocarboxylated hydrocarbons.

7. A process according to claim 6, wherein n is 5.

8. A process according to claim 6, wherein the composition contains 60 to 75% by weight of the amphiphilic compound, 15 to 20% of water and 10 to 20% of an agent which promotes miscibility of the amphiphilic compound in water.

9. A process according to claim 8, wherein the agent which promotes the miscibility of the amphiphilic compound in water is a lower alcohol, diacetone alcohol, a glycol, a glycol ether oxide or a mixture thereof.

10. A process according to claim 9, wherein the agent is diethylene glycol monobutyl oxide.

11. A process according to claim 10, wherein n is 5.

12. The process of claim 1, wherein the applied composition comprises at least 70% by weight of the amphiphilic compound.

13. A composition for degreasing a surface of a metal, ceramic, glass or plastic object having oil or grease on said surface which consists essentially of 15 to 20% by weight of water and 85 to 60% by weight of an amphiphilic compound which is an alkyleneglycol ether oxide of the formula

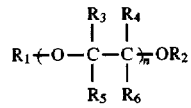

wherein $R_1$ is a hydrogen atom or a hydrocarbon group, optionally substituted, having 1 to 20 carbon atoms, or a hydrocarbylcarbonyl group having 1 to 21 carbon atoms, $R_2$ is a hydrogen atom or a hydrocarbon group, optionally substituted, having 1 to 20 carbon atoms, at least one of $R_1$ and $R_2$ having at least 10 carbon atoms, $R_3$, $R_4$, $R_5$ and $R_6$, which are identical or different, denote hydrogen or a hydrocarbon group, optionally substituted, having 1 to 6 carbon atoms, and n is an integer from 1 to 12.

14. A composition according to claim 13, consisting essentially of 60 to 75% by weight of the amphiphilic compound, 15 to 20% of water and 10 to 20% of an agent which promotes miscibility of the amphiphilic compound in water.

15. A composition according to claim 14, wherein the agent which promotes the miscibility of the amphiphilic compound in water is a lower alcohol, diacetone alcohol, a glycol a glycol ether oxide or a mixture thereof.

16. A composition according to claim 15, wherein the agent is diethylene glycol monobutyl oxide.

17. A composition according to claim 15, wherein n is 2 to 5 inclusive, $R_2$ is methyl and $R_1$ is a mixture of $C_{11}$, $C_{13}$ and $C_{18}$ monocarboxylated hydrocarbons.

18. A composition according to claim 17, wherein n is 5.

19. A composition according to claim 18, wherein the agent is diethylene glycol monobutyl oxide.

20. The composition of claim 13, which comprises 85 to 70% by weight of the amphiphilic compound.

* * * * *